US010852663B2

(12) United States Patent
Nakajima et al.

(10) Patent No.: US 10,852,663 B2
(45) Date of Patent: Dec. 1, 2020

(54) IMAGE FORMATION APPARATUS AND IMAGE FORMATION PART SELECTION METHOD

(71) Applicant: Oki Data Corporation, Tokyo (JP)

(72) Inventors: Hirofumi Nakajima, Tokyo (JP); Yasuhiro Suda, Tokyo (JP)

(73) Assignee: Oki Data Corporatio, Tokyo (JP)

( * ) Notice: Subject to any disclaimer, the term of this patent is extended or adjusted under 35 U.S.C. 154(b) by 0 days.

(21) Appl. No.: 16/812,347

(22) Filed: Mar. 8, 2020

(65) Prior Publication Data

US 2020/0310284 A1 Oct. 1, 2020

(30) Foreign Application Priority Data

Mar. 27, 2019 (JP) ..... 2019-061855

(51) Int. Cl.
*G03G 15/08* (2006.01)

(52) U.S. Cl.
CPC ..... *G03G 15/0849* (2013.01)

(58) Field of Classification Search
CPC ..... G03G 15/0849; G03G 15/5079; G03G 15/553; G03G 15/751; G03G 2215/0602
USPC ..... 399/9, 24–29, 38, 42
See application file for complete search history.

(56) References Cited

U.S. PATENT DOCUMENTS 7,242,878 B2 * 7/2007 Kojima ..... G03G 15/0849 399/24
10,129,436 B2 * 11/2018 Kimura ..... G03G 15/55

FOREIGN PATENT DOCUMENTS

JP 2017-181616 A 10/2017

* cited by examiner

*Primary Examiner* — Hoan H Tran
(74) *Attorney, Agent, or Firm* — Metrolex IP Law Group, PLLC

(57) ABSTRACT

An image formation apparatus according to one or more embodiment may include: image formation parts each including a developer image development part, a developer container that accommodates a developer, and a deteriorated developer container that accommodates a deteriorated developer discharged from the developer image development part; a collection part that collects a value based on a history of printing rates of each of the image formation parts; a printing rate calculator that calculates a printing rate of a received print data; and an image formation part selector that selects, based on the value based on the history of printing rates of each of the image formation parts collected by the collection part and the printing rate of the received printed data calculated by the printing rate calculator, one of the image formation parts, to be used for performing printing of the received print data.

6 Claims, 11 Drawing Sheets

TONER DISPOSAL PATTERN

FIG. 7

TB1

| | | COMPARISON BETWEEN PRINTING RATE Lduty AND TONER DISPOSAL SLICE VALUE LS | |
|---|---|---|---|
| | | Lduty>LS (HIGH DUTY) | Lduty≦LS (LOW DUTY) |
| COMPARISON BETWEEN DETERIORATED TONER COUNTS | LA≧LE | SELECT IMAGE FORMATION UNIT 8A | SELECT IMAGE FORMATION UNIT 8E |
| | LA<LE | SELECT IMAGE FORMATION UNIT 8E | SELECT IMAGE FORMATION UNIT 8A |

FIG. 9

TB2

| | IMAGE FORMATION UNIT 8A | IMAGE FORMATION UNIT 8E |
|---|---|---|
| DETERIORATED TONER COUNTS | 0.0 | 0.0 |
| TONER DISPOSAL SLICE VALUE | 1.8 | 1.8 |

| | | |
|---|---|---|
| DRUM COUNTS | 15000 | 15000 |
| DRUM LIFE DURATION VALUE | 25000 | 25000 |

| | | |
|---|---|---|
| WASTE TONER COUNTS | 630000 | 750000 |
| WASTE TONER LIFE DURATION VALUE | 1086480 | 1086480 |

| | |
|---|---|
| BELT COUNTS | 62000 |
| BELT LIFE DURATION VALUE | 100000 |

FIG. 10

TB3

| | IMAGE FORMATION UNIT 8A | | | | IMAGE FORMATION UNIT 8E | | | | |
|---|---|---|---|---|---|---|---|---|---|
| PRINTING RATE OF EACH JOB Lduty | TOTAL OF PRINTING RATES | NUMBER OF PRINTED SHEETS | AVERAGE | DETERIORATED TONER COUNTS LA | TOTAL OF PRINTING RATES | NUMBER OF PRINTED SHEETS | AVERAGE | DETERIORATED TONER COUNTS LE | SELECTED IMAGE FORMATION UNIT |
| | 0 | 0 | 0 | 0 | 0 | 0 | 0 | 0 | E |
| 2 | 2 | 1 | 2 | -0.2 | 0 | 0 | 0 | 0 | A |
| 3 | 2 | 1 | 2 | -0.2 | 3 | 1 | 3 | -1.2 | E |
| 2 | 2 | 1 | 2 | -0.2 | 5 | 2 | 2.5 | -1.4 | E |
| 0.5 | 2 | 1 | 2 | -0.2 | 5.5 | 3 | 1.833 | -0.1 | E |
| 3 | 2 | 1 | 2 | -0.2 | 8.5 | 4 | 2.125 | -1.3 | E |
| 2 | 2 | 1 | 2 | -0.2 | 10.5 | 5 | 2.1 | -1.5 | E |
| 1 | 2 | 1 | 2 | -0.2 | 11.5 | 6 | 1.917 | -0.7 | E |
| 1.8 | 3.8 | 2 | 1.9 | -0.2 | 11.5 | 6 | 1.917 | -0.7 | A |
| 0.5 | 3.8 | 2 | 1.9 | -0.2 | 12 | 7 | 1.714 | 0.6 | E |
| 1.4 | 5.2 | 3 | 1.733 | 0.2 | 12 | 7 | 1.714 | 0.6 | A |
| 100 | 5.2 | 3 | 1.733 | 0.2 | 112 | 8 | 14 | 97.6 | E |
| 5 | 5.2 | 3 | 1.733 | 0.2 | 117 | 9 | 13 | 100.8 | E |
| 5 | 5.2 | 3 | 1.733 | 0.2 | 122 | 10 | 12.2 | -104 | E |
| 5 | 5.2 | 3 | 1.733 | 0.2 | 127 | 11 | 11.55 | -107.2 | E |
| 5 | 5.2 | 3 | 1.733 | 0.2 | 132 | 12 | 11 | -110.4 | E |
| 5 | 5.2 | 3 | 1.733 | 0.2 | 137 | 13 | 10.54 | -113.6 | E |
| 5 | 5.2 | 3 | 1.733 | 0.2 | 142 | 14 | 10.14 | -116.8 | E |

FIG. 11

TB4

| | IMAGE FORMATION UNIT 8A | | IMAGE FORMATION UNIT 8E | | |
|---|---|---|---|---|---|
| PRINTING RATE OF EACH JOB Lduty | NUMBER OF PRINTED SHEETS | DETERIORATED TONER COUNTS LA | NUMBER OF PRINTED SHEETS | DETERIORATED TONER COUNTS LE | SELECTED IMAGE FORMATION UNIT |
| | 0 | 0 | 0 | 0 | E |
| 2 | 1 | -0.2 | 0 | 0 | A |
| 3 | 1 | -0.2 | 1 | -1.2 | E |
| 2 | 2 | -0.4 | 1 | -1.2 | A |
| 0.5 | 2 | -0.4 | 2 | 0.1 | E |
| 3 | 2 | -0.4 | 3 | -1.1 | E |
| 2 | 3 | -0.6 | 3 | -1.1 | A |
| 1 | 3 | -0.6 | 4 | -0.3 | E |
| 1.8 | 4 | -0.6 | 4 | -0.3 | A |
| 0.5 | 5 | -0.7 | 4 | -0.3 | A |
| 1.4 | 5 | -0.7 | 5 | 0.1 | E |
| 100 | 6 | -97.5 | 5 | 0.1 | A |
| 5 | 6 | -97.5 | 6 | -3.1 | E |
| 5 | 6 | -97.5 | 7 | -6.3 | E |
| 5 | 6 | -97.5 | 8 | -9.5 | E |
| 5 | 6 | -97.5 | 9 | -12.7 | E |
| 5 | 6 | -97.5 | 10 | -15.9 | E |
| 5 | 6 | -97.5 | 11 | -19.1 | E |

IMAGE FORMATION APPARATUS AND IMAGE FORMATION PART SELECTION METHOD

CROSS REFERENCE TO RELATED APPLICATIONS

This application claims priority based on 35 USC 119 from prior Japanese Patent Application No. 2019-061855 filed on Mar. 27, 2019, entitled "IMAGE FORMATION APPARATUS AND IMAGE FORMATION PART SELECTION METHOD", the entire contents of which are incorporated herein by reference.

BACKGROUND

The disclosure may relate to an image formation apparatus and an image formation part selection method, which may be suitably applied to an image formation apparatus configured to transfer a developer image to a recording medium to form an image.

In an electrophotographic image formation apparatus in a related art, when repeatedly executes printing, a toner may be deteriorated in a development device in each of image formation units, to produce a deteriorated toner. Therefore, the image formation apparatus executes a deteriorated toner disposal process to discharge the deteriorated toner from the development device to a photosensitive drum and collect the discharged deteriorated toner in a waste toner container in the image formation unit. When print data having a high printing rate is printed, the toner is used for development before the toner is deteriorated in the development device and thus the deteriorated toner may hardly be generated in the development device. On the other hand, when the print data having low printing rates are repeatedly printed, the toner may be deteriorated in the development device before the toner is used for development. Therefore, the image formation apparatus executes the deteriorated toner disposal only when the print data having low printing rates have been repeatedly printed. Note that, for example, for one page of a sheet, the printing rate is defined as a ratio of the number of dots to be printed on the sheet to the number of dots that are printable over the sheet. When the number of the dots used for printing is large, the printing is a high duty printing, whereas when the number of the dots used for printing is small, the printing is a low duty printing. (see for example, Patent Document 1)

Patent Document 1: Japanese Patent Application Publication No. 2017-181616

SUMMARY

However, in such an image formation apparatus, the amounts of the deteriorated toners in the development devices may be disproportionate between the image formation units, and thus only a part of the image formation units may execute a large number of the deteriorated toner disposal processes. Accordingly, in a case where the image formation unit is formed integrally with the waste toner container, when the waste toner container is full even if the image formation unit has not yet reached the end of the life, the image formation unit needs to be replaced and this makes a replacement cycle of the image formation unit shorter. Further in a case where the image formation units of all colors are integrally formed with each other, when the waste toner container of one of the image formation units is full, all of the image formation units need to be replaced together and this makes the replacement cycles thereof shorter.

An object of an aspect of one or more embodiments may be to provide an image formation apparatus and an image formation part selection method capable of extending replacement cycles of image formation parts.

A first aspect of one or more embodiments may be an image formation apparatus that include: a plurality of image formation parts each of which includes: a developer image development part configured to form a developer image; a developer container that accommodates a developer to be supplied to the developer image development part, and a deteriorated developer container that accommodates a deteriorated developer discharged from the developer image development part; a collection part that collects a value based on a history of printing rates of each of the plurality of image formation parts; a printing rate calculator that calculates a printing rate of a received print data; and an image formation part selector that selects, based on the value based on the history of printing rates of each of the plurality of image formation parts collected by the collection part and the printing rate of the received printed data calculated by the printing rate calculator, one of the plurality of image formation parts, to be used for performing printing of the received print data.

A second aspect of one or more embodiments may be a method of selecting, among a plurality of image formation parts each of which includes a developer image development part configured to form a developer image, one of the plurality of image formation parts, to be used for printing. The method may include: storing a value based on a history of printing rates of each of the plurality of image formation parts; calculating a printing rate of a received print data; and selecting, based on the value based on the history of printing rates of each of the image formation parts and the printing rate of the received printed data, one of the plurality of image formation parts, to be used for performing printing of the received print data.

According to at least one of the above described aspects, when printing at a high printing rate, one of the image formation parts that contains the deteriorated developer more than the other(s) performs printing to use the developer for the development before the developer is deteriorated. To the contrary, when printing at a low printing rate, which tends to generate the deteriorated developer, one of the image formation parts that contains the deteriorated developer less than the other(s) executes printing. Accordingly, the deteriorated developers are efficiently accumulated by decreasing a difference between amounts of the deteriorated developers of the same color image formation parts.

Accordingly, an image formation apparatus or an image formation part selection method capable of extending replacement cycles of image formation parts can be realized.

BRIEF DESCRIPTION OF DRAWINGS

FIG. 7 is a diagram illustrating a view of an image formation unit selection condition table.

FIG. 9 is a diagram illustrating a view of the image formation apparatus status table.

FIG. 10 is a diagram illustrating a view of a print result table indicating a print result of an image formation apparatus according to a comparison example.

FIG. 11 is a diagram illustrating a view of a print result table of the image formation apparatus according to an embodiment.

DETAILED DESCRIPTION

Figure 1:
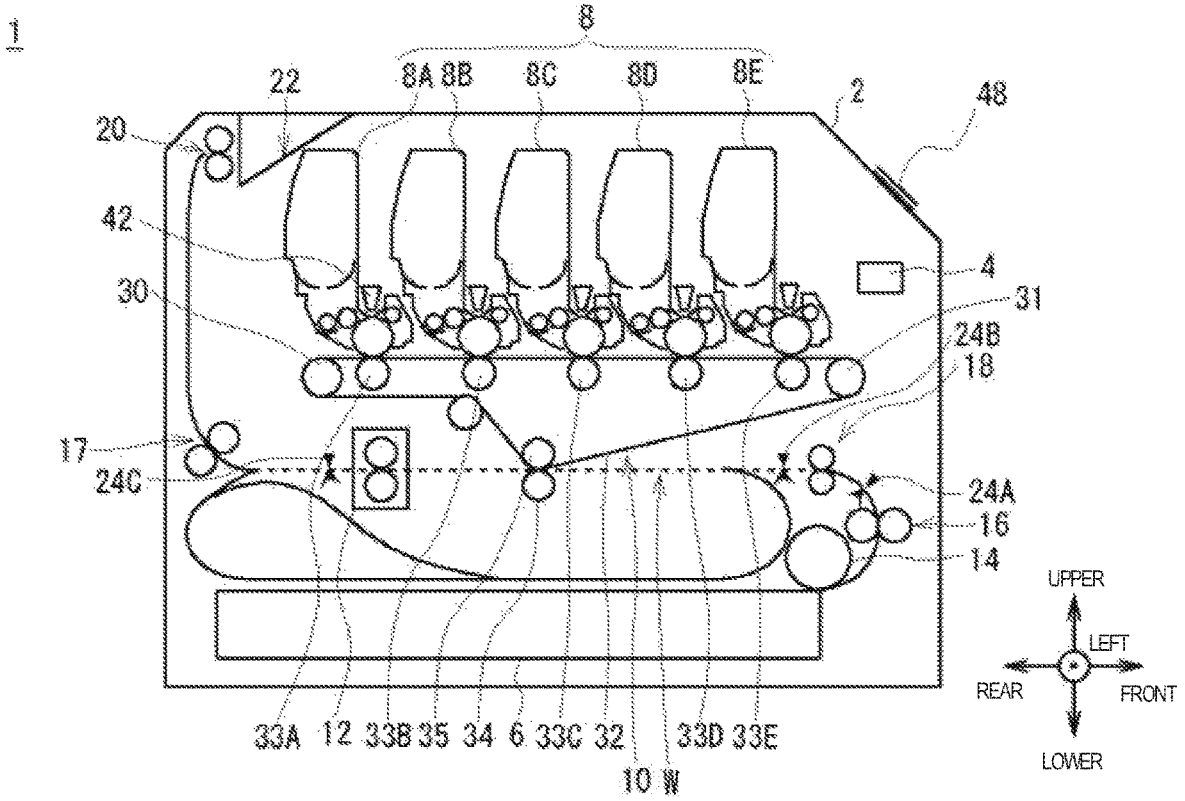
FIG. 1 is a diagram illustrating a left side view of an overall configuration of an image formation apparatus.

Descriptions are provided hereinbelow for one or more embodiments based on the drawings. In the respective drawings referenced herein, the same constituents are designated by the same reference numerals and duplicate explanation concerning the same constituents is omitted. All of the drawings are provided to illustrate the respective examples only.

1. Overall Configuration of Image Formation Apparatus

As illustrated in FIG. 1, an image formation apparatus 1 has a box-shaped housing 2 in which various components are arranged. In the following, the right side of FIG. 1 is defined as a front side of the image formation apparatus 1, and as being viewed facing the front surface of the image formation apparatus 1, up (upper), down (lower), left, right, front, and rear directions are defined, respectively. The image formation apparatus 1 includes a controller 4 configured to control an overall of the image formation apparatus 1. The controller 4 is connected to an external apparatus or a host apparatus (not shown) such as a computer device by a wireless and/or wired connection. The controller 4 receives, from an external apparatus, print data indicating an image to be printed and executes, in response to an instruction to print the received print data, a printing process to print the image based on the print data on a surface of paper. In the housing 2, a paper cassette 6, image formation units 8 (image formation units 8A, 8B, 8C, 8D, and 8E), an intermediate transfer unit 10, a fixation device 12, a paper feed roller 14, a conveyance roller pair 16, a conveyance roller pair 17, a resist roller pair 18, a discharge roller pair 20, a paper feed sensor 24A, a write sensor 24B, and a discharge sensor 24C are provided.

The paper cassette 6 defines a space to accommodate therein sheets such as paper and provided at a lower portion in the housing 2. The image formation units 8 (8A to 8E) are units configured to execute electrophotographic image forming processes, and provided at an upper portion in the housing 2. The image formation units 8 (8A to 8E) handle different developers respectively. For example, the image formation unit 8A uses a black developer, the image formation unit 8B uses a yellow developer, the image formation unit 8C uses a magenta developer, the image formation unit 8D uses a cyan developer, and the image formation unit 8E uses a black developer. Specifically, toners are used as the developers. The image formation units 8A, 8B, 8C, 8D, and 8E have the same configuration except for the colors of the toner which handle. Each of the image formation units 8 (8A, 8B, 8C, 8D, and 8E) includes a photosensitive drum 45 (FIG. 2) which is movable in the up and down directions such that the photosensitive drum 45 is in contact with or away from a primary transfer roller 33 (33A, 33B, 33C, 33D, and 33E). In the following, a state where the photosensitive drum 45 is in contact with the primary transfer roller 33 may be referred to as a transfer position, and a state where the photosensitive drum 45 is separated away from the primary transfer roller 33 may be referred to as a non-transfer position. As described above, the image formation apparatus 1 includes two image formation units 8A and 8E each of which transfers the black toner.

The intermediate transfer unit 10 is a unit or a device configured to execute electrophotographic image transferring processes and provided at a position below the image formation units 8 (8A to 8E). The intermediate transfer unit 10 includes a belt tension roller 30, a belt drive roller 31, an intermediate transfer belt 32, primary transfer rollers 33 (33A to 33E), a secondary transfer roller 34, and a secondary transfer backup roller 35.

The intermediate transfer belt 32 is wound around the belt tension roller 30, the belt drive roller 31, and the secondary transfer backup roller 35 in a stretch manner to form an inverted triangle shape having an upper line being flat and a lower line being projected downwardly. Beneath the flat upper line, extending in the front-rear direction, of the intermediate transfer belt 32, the primary transfer rollers 33A to 33E are arranged to be respectively opposed to the image formation units 8A to 8E with the flat upper line of the intermediate transfer belt 32 therebetween. The secondary transfer roller 34 and the secondary transfer backup roller 35 are provided to be opposed to each other with the lower line, projected downwardly, of the intermediate transfer belt 32, being sandwiched therebetween.

While the intermediate transfer belt 32 is running in a clockwise direction in FIG. 1, toner images are transferred to the flat upper line of the intermediate transfer belt 32 by the image formation units 8 (8A to 8E) and the primary transfer rollers 33 (33A to 33E). The toner images primarily transferred on the intermediate transfer belt 32 are traveled together with the intermediate transfer belt 32 in the clockwise direction and then secondarily transferred onto paper when the paper passes through a nip portion between the secondary transfer roller 34 and the secondary transfer backup roller 35.

The fixation device 12 is a unit or a device configured to execute an electrophotographic fixation process and is provided downstream, in a paper conveyance path W extending in the front-rear direction, of the nip portion between the portion between the secondary transfer roller 34 and the secondary transfer backup roller 35. The fixation device 12 includes a heating roller and a pressure roller which are opposed to each other with the conveyance path W being sandwiched therebetween. The heating roller has a circular cylindrical shape having an axis thereof extending in the left-right direction, and contains a heater therein. The pressure roller has also a circular cylindrical shape like the heating roller. The pressure roller is pressed against the heating roller such that an upper surface of the pressure roller is pressed against a lower surface of the heating roller with a predetermined pressure. Based on the control of the controller 4, the heating roller of the fixation device 12 is heated and the heating roller and the pressure roller are rotated in the predetermined rotational directions respectively. With this operation, the fixation device 12 applies the heat and pressure on the paper received from the intermediate transfer unit 10, that is, the paper on which the toner images are transferred and overlaid to each other, so as to fix the toner to the paper, and further conveys the paper in the downstream direction in the conveyance path W.

The paper feed roller 14 is a roller to feed the paper from the paper cassette 6 to the conveyance path W. The conveyance roller pair 16 is a pair of rollers, opposed to each other with the conveyance path W therebetween and pressing each other, to convey the paper fed from the paper cassette 6 toward the resist roller pair 18 in the conveyance path W. The resist roller pair 18 is a pair of rollers, opposed to each other with the conveyance path W therebetween and pressing each other, to correct skew of the paper conveyed from the conveyance roller pair 16 and then further convey the paper toward the nip portion between the secondary transfer roller 34 and the secondary transfer backup roller 35.

Each of the conveyance roller pair 17 and the discharge roller pair 20 is a pair of rollers, opposed to each other with the conveyance path W therebetween and pressing each other, to further convey and discharge the paper on which the tone images are fixed by the fixation device 12 to a discharged paper tray 22 provided on the top of the housing 2.

The paper feed sensor 24A, the write sensor 24B, and the discharge sensor 24C are paper detection sensor to recognize (detect) the paper passing therethrough. Each of the sensors mechanically operates in response to the passage of the paper, and transmits the detection result to the controller 4. The controller 4 monitors (measures) the time (paper detection timing) that each of the paper feed sensor 24A, the write sensor 24B, and the discharge sensor 24C detects the paper, and thus detects a delay of the paper conveyance, a paper jam, and the like.

With this configuration, upon executing a print process, the image formation apparatus 1 feeds and conveys the paper from the paper cassette 6 in the downstream direction toward the nip portion of the intermediate transfer unit 10, and transfers the toner images formed on the intermediate transfer belt 32 onto the paper when the paper passing the nip portion. The image formation apparatus 1 further conveys the paper on which the toner images are transferred to the fixation device 12, fixes the toner images to the paper by the heat and the pressure of the fixation device 12 when the paper passing the fixation device, and then discharges the paper to the discharged paper tray 22.

2. Configuration of Image Formation Unit

Figure 2:
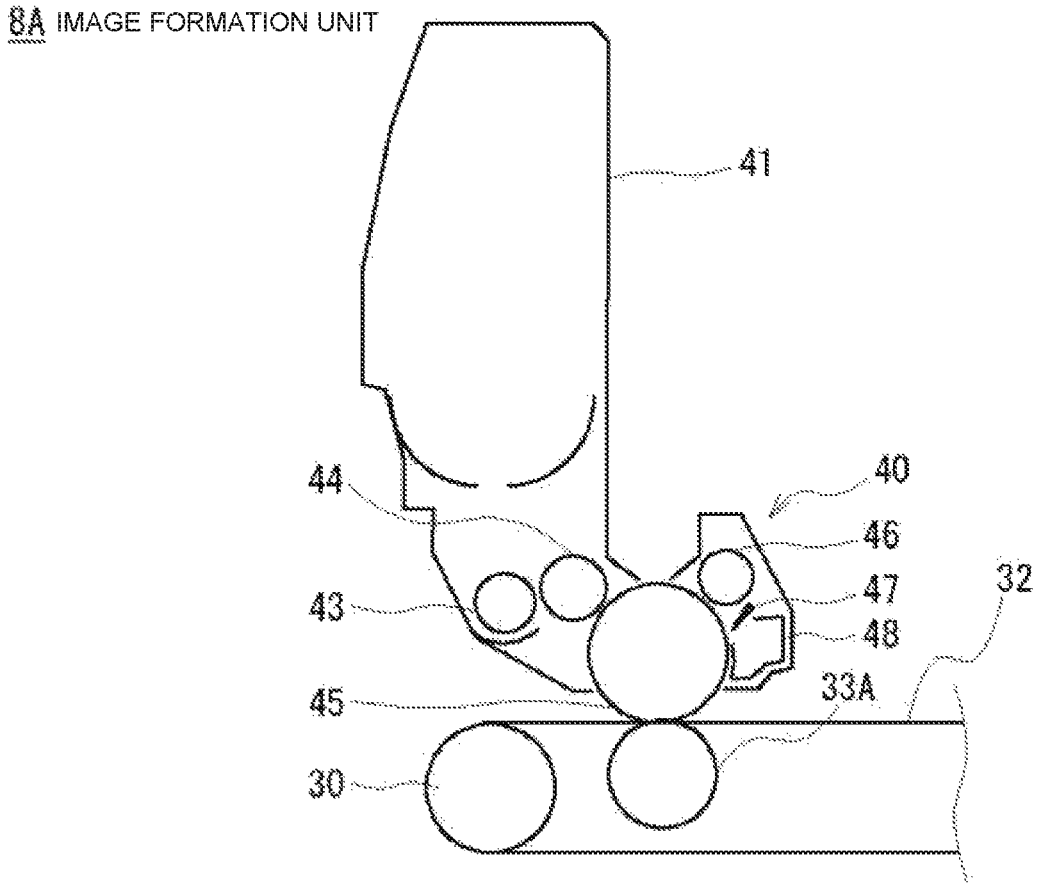
FIG. 2 is a diagram illustrating a left side view of a configuration of an image formation unit.

Next, a configuration of the image formation unit 8 is described below. All of the image formation units 8A, 8B, 8C, 8D, and 8E have the same or substantially the same configuration, and thus only one of them, e.g. the image formation unit 8A, is described below for avoid redundancies. As shown in FIG. 2 illustrating the left side view, the image formation unit 8A includes a development device 40, a toner cartridge 41, and a print head 42 (FIG. 1). The intermediate transfer belt 32 is sandwiched between the image formation unit 8A and the primary transfer roller 33 provided below the image formation unit 8A.

The toner cartridge 41 contains therein a toner serving as a developer. The toner cartridge 41 is provided above the development device 40 and attached to the development device 40. The toner cartridge 41 supplies the toner contained therein to the development device 40. The development device 40 includes a supply roller 43, a development roller 44, a photosensitive drum 45, a charging roller 46, a cleaning blade 47, and a waste toner collection container 48 which are built therein.

The supply roller 43 has a circular cylindrical shape having an axis thereof extending in the left-right direction, and includes, on the outer circumference surface, an elastic layer formed of, for example, a conductive urethane rubber foam or the like. The development roller 44 has a circular column shape having an axis thereof extending in the left-right direction, and includes, on the outer circumference surface thereof, a surface layer including an elastic layer, a conductive surface layer, or the like. The photosensitive drum 45 has a circular column shape having an axis thereof extending in the left-right direction, and includes a thin charge generation layer and a thin charge transport layer formed in this order on the outer circumference surface of the drum 45, so that the photosensitive drum 45 can be charged. The charging roller 46 has a circular column shape having an axis thereof extending in the left-right direction, and includes a conductive elastic layer on the outer circumference surface thereof. The outer circumference surface of the charging roller 46 is in contact with the outer circumference surface of the photosensitive drum 45.

The development device 40 receives a driving force from an unillustrated drum motor to rotate the supply roller 43, the development roller 44, and the charging roller 46, as well as the photosensitive drum 45. The development device 40 applies predetermined bias voltages to the supply roller 43, the development roller 44, and the charging roller 46, respectively, to charge the supply roller 43, the development roller 44, and the charging roller 46.

The toner from the toner cartridge 41 is attached onto the charged outer circumferential surface of the supply roller 43, and the toner attached on the charged outer circumferential surface of the supply roller 43 is attached to the outer circumferential surface of the development roller 44, while the supply roller 43 is rotating. The outer circumferential surface of the development roller 44 is in contact with the outer circumferential surface of the photosensitive drum 45. The charging roller 46 with being charged is in contact with the photosensitive drum 45, to uniformly charge the outer circumferential surface of the photosensitive drum 45. The print head 42 (FIG. 1) includes a plurality of light emitting element chips arranged in a line along the left-right direction and emits lights of a light emission pattern based on image data signals supplied from the controller 4 (FIG. 1) at predetermined time intervals, so as to expose the photosensitive drum 45. With this, an electrostatic latent image is formed on the outer circumferential surface of the photosensitive drum 45 in the vicinity of the top of the photosensitive drum 45. Then, due to the rotation of the photosensitive drum 45, an area of the outer circumferential surface of the photosensitive drum 45 in which the electrostatic latent image is formed comes in contact with the development roller 44. Accordingly, the toner is attached to the electrostatic latent image of the outer circumferential surface of the photosensitive drum 45, so that a toner image based on the image data is developed on the photosensitive drum 45.

The primary transfer roller 33 is provided directly below the photosensitive drum 45, in such a manner that the upper line of the intermediate transfer belt 32 is sandwiched between an upper end portion of the primary transfer roller 33 and a lower end portion of the photosensitive drum 45. The primary transfer roller 33 receives a predetermined bias voltage and is rotated by a driving force received from an unillustrated drum motor. Accordingly, the image formation unit 8 transfers the toner image developed on the outer circumferential surface of the photosensitive drum 45 onto the paper which is conveyed along the conveyance path W.

The cleaning blade 47 is a blade formed of urethane rubber. The cleaning blade 47 is in contact with on the outer circumferential surface of the photosensitive drum 45 at a position downstream of the contact position of the primary transfer roller 33 in the rotational direction of the photosensitive drum 45, and removes (scrapes) the residual toner that remains on the photosensitive drum 45 after the transfer. The waste toner collection container 48 is a container that collects and stores therein the waste toner and the residual toner removed from the photosensitive drum 45 in the printing process and a later described deteriorated toner disposal process. The waste toner collection container 48 is formed integrally with the development device 40. When the waste toner collection container 48 gets full, the development device 40 needs to be replaced. Also when the life duration of the photosensitive drum 45 comes to the end, the development device 40 needs to be replaced.

Each of the image formation units 8 of the respective color transfers the toner image therefrom to the paper being conveyed along the conveyance path W from the front side as described above, to superpose the toner images of the respective colors on the paper and conveys the paper toward the rear side along the conveyance path W.

3. Control-Related Configuration of Image Formation Apparatus

Figure 3:
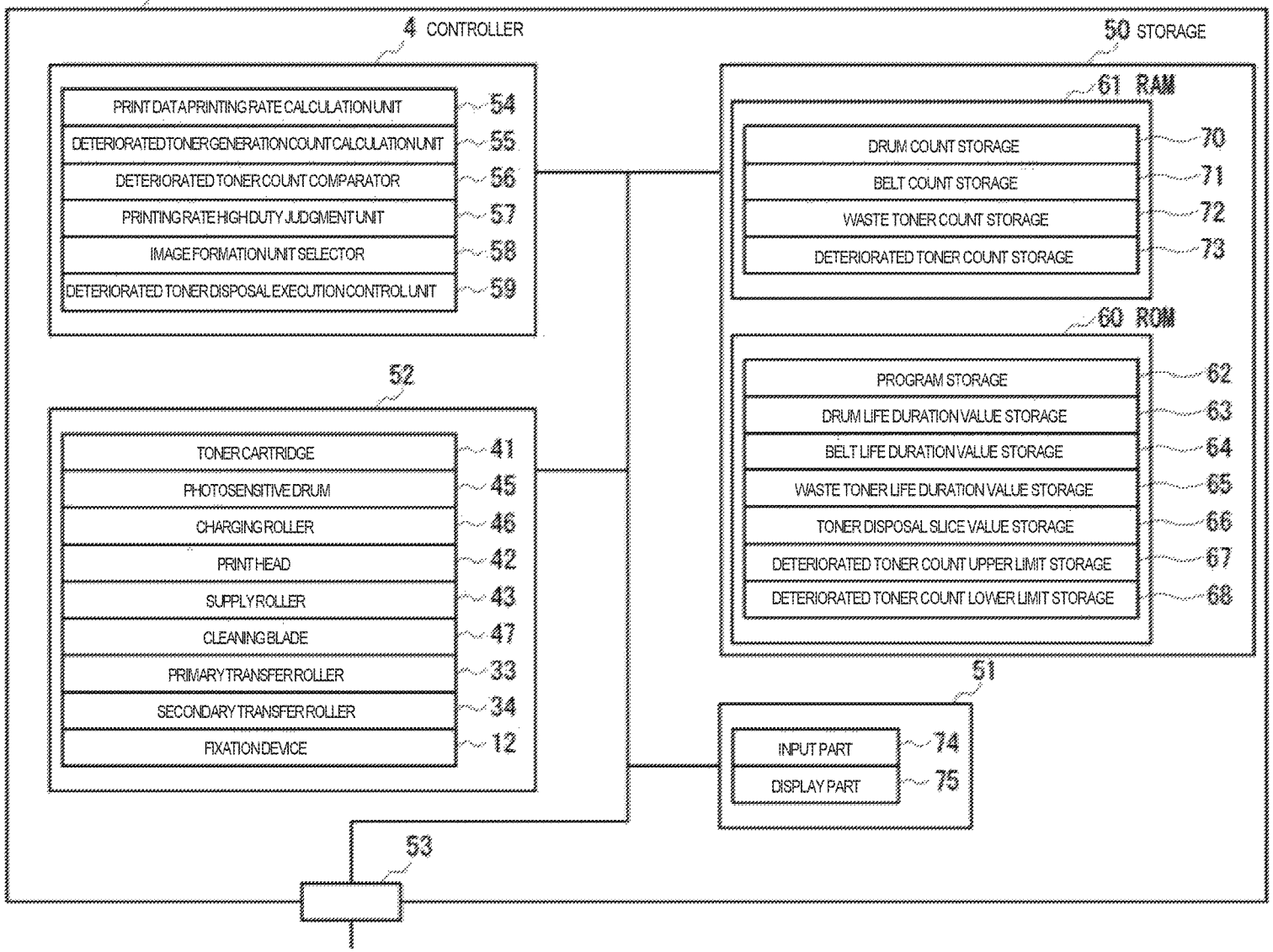
FIG. 3 is a block diagram illustrating a view of a control-related configuration of the image formation apparatus.

As illustrated in FIG. 3, the image formation apparatus 1 includes the controller 4, a storage 50, an operation panel 51, an image formation section 52, and a communication unit 53. The controller 4 controls the entire of the image formation apparatus 1. The controller 4 includes an unillustrated CPU (Central Processing Unit) as a main component, and reads out programs from a program storage 62 of a storage 50 or a memory and executes them, to control the parts or the units in the apparatus to execute various processes. Further, the controller 4 includes a print data printing rate calculation unit 54, a deteriorated toner generation count calculation unit 55, a deteriorated toner count comparator 56, a printing rate high duty judgment unit 57, an image formation unit selector 58, and a deteriorated toner disposal execution control unit 59.

The print data printing rate calculation unit 54 calculates a printing rate Lduty of the print data of a job to be printed. The printing rate Lduty for one page of a sheet is a ratio of an area of an image to be actually formed on the sheet to an area of a solid image formed over a predetermined printable area on the sheet. The printing rate Lduty for one job is an average value of the printing rates of all pages included in the one job. In other words, the printing rate Lduty for one page of a sheet is a ratio of the number of dots that are to be actually printed on the sheet, to the number of dots that covers the entire of the predetermined printable area on the sheet as a ratio of 100%. The deteriorated toner generation count calculation unit 55 calculates a count value indicating an amount of a deteriorated toner occurred in the image formation unit 8 that has performed printing.

The deteriorated toner count comparator 56 compares, in a later-described image formation unit selection process, deteriorated toner counts L of the image formation unit 8A and the image formation unit 8E, both of which use the toners of the same color, e.g. black. Specifically, the deteriorated toner count comparator 56 compares the value of the deteriorated toner counts LA, which is the value of the deteriorated toner counts L of the image formation unit 8A, with the value of the deteriorated toner counts LE, which is the value of the deteriorated toner counts L of the image formation unit 8E, and determines whether or not the value of the deteriorated toner counts LA is equal to or more than the value of the deteriorated toner counts LE.

The printing rate high duty judgment unit 57 compares a later described toner waste slice value LS and the printing rate Lduty of the print job, and determines whether the printing rate Lduty is more than the toner waste slice value LS, that is, determines whether the printing rate Lduty of the print job is a high duty (a high printing rate) or not.

The image formation unit selector 58 selects one of the image formation units 8 for the black toners, that is, selects one the image formation unit 8A and the image formation unit 8E, based on the determination result of the deteriorated toner count comparator 56 and the determination result of the printing rate high duty judgment unit 57.

Figure 4:
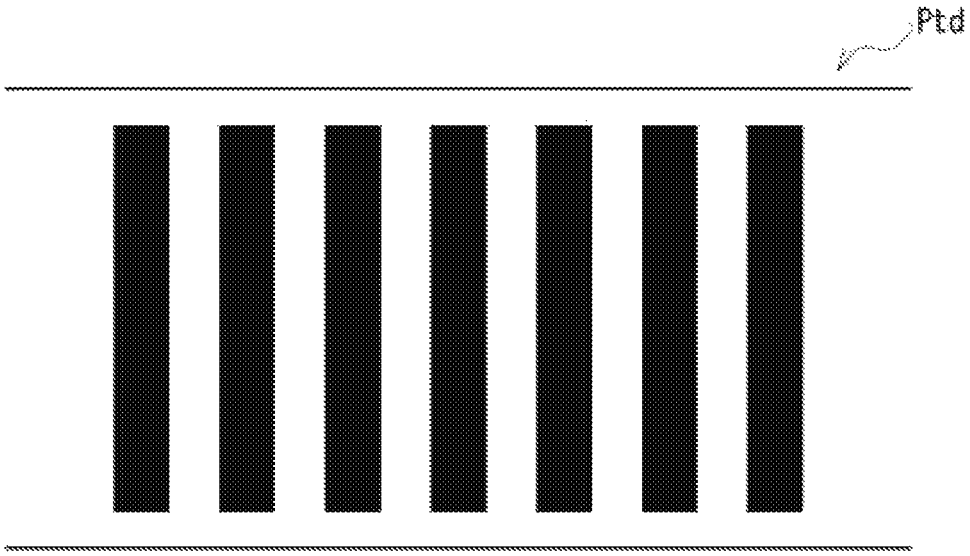
FIG. 4 is a diagram illustrating a view of a toner disposal pattern.

The deteriorated toner disposal execution control unit 59 instructs the print head 42 to emit the LED (Light Emitting Diode) light to form a latent image of a toner disposal pattern Ptd, as illustrated in FIG. 4 for example, onto the surface of the photosensitive drum 45 charged by the charging roller 46. FIG. 4 is a development view of the surface of the photosensitive drum 45 on which the toner of the toner disposal pattern Ptd is attached. The toner disposal pattern Ptd is, for example, an electrostatic latent image pattern in which 1, 0, 1, 0 . . . are repeated in the axial direction of the photosensitive drum 45 and whose printing rate is 50 [%].

The storage 50 includes a ROM (Read Only Memory) 60, a RAM (Random Access Memory) 61, and a flash memory (not illustrated). ROM 60 include, in addition to the program storage 62, a drum life duration value storage 63, a belt life duration value storage 64, a waste toner life duration value storage 65, a toner waste slice value storage 66, the deteriorated toner count upper limit storage 67, and a deteriorated toner count lower limit storage 68.

The drum life duration value storage 63 stores therein a drum life duration value indicating a value of a life span of the photosensitive drum 45. The belt life duration value storage 64 stores therein a belt life duration value indicating a value of a life span of the intermediate transfer belt 32. The waste toner life duration value storage 65 stores therein a waste toner life duration value indicating an amount of the waste toner when the waste toner collection container 48 is full with the waste toner. The toner waste slice value storage 66 stores therein the toner waste slice value LS. The toner waste slice value LS is a threshold to be used when calculating later described deteriorated toner generation counts Lcount. The deteriorated toner count upper limit storage 67 stores therein a later described deteriorated toner count upper limit value Lmax. The deteriorated toner count lower limit storage 68 stores therein a later-described deteriorated toner count lower limit value Lmin.

RAM 61 includes a drum count storage 70, a belt count storage 71, a waste toner count storage 72, and a deteriorated toner count storage 73.

The drum count storage 70 stores therein a value of drum counts, which is a counter value indicating a usage amount of the photosensitive drum 45 of each of the image formation units 8. The number of the counts (drum counts) to be stored in the drum count storage 70 is incremented by one, every one third of a drum rotation amount when continuously printing three sheets of A4 paper. When the value of the drum counts reaches the drum life duration value stored in the drum life duration value storage 63, the development device 40 including the photosensitive drum 45 needs to be replaced in the image formation apparatus 1.

The belt count storage 71 stores therein belt counts, which is a counter value indicating a usage amount of the intermediate transfer belt 32. The number of the counts (belt counts) to be stored in the belt count storage 71 is incremented by one, every time one sheet of paper is printed. When the value of the belt counts reaches the belt life duration value stored in the belt life duration value storage 64, the intermediate transfer belt 32 needs to be replaced from the image formation apparatus 1.

The waste toner count storage 72 stores therein a value of waste toner counts which is a counter value indicating an amount of the waste toner in the waste toner collection container 48 of each of the image formation units 8. When the value of the waste toner counts reaches the waste toner life duration value stored in the waste toner life duration value storage 65, the development device 40 including the waste toner collection container 48 needs to be replaced from the image formation apparatus 1.

The deteriorated toner count storage 73 stores therein deteriorated toner counts L, which a counter value indicating a total amount of the deteriorated toner of each of the image formation units 8. The deteriorated toner count storage 73 stores the value of the deteriorated toner counts in units of 0.1 [%].

An operation panel 51 is a touch panel including a display part 75 formed of a LCD (Liquid Crystal Display) panel that displays a state of the image formation apparatus 1 and an input part 74 formed of a touch sensor that detects an input operation from an user, wherein the display part 75 and the input part 74 are integrally formed.

The image formation section 52 includes the toner cartridge 41, the photosensitive drum 45, the charging roller 46, the print head 42, the supply roller 43, the development roller 44, the cleaning blade 47, the primary transfer roller 33, the secondary transfer roller 34, the fixation device 12, and etc.

The communication unit 53 is an interface configured to execute a network communication such as a wired LAN (Local Area Network) communication and/or a wireless LAN communication. The communication unit 53 communicates with the outside, for example, transmits and receives data to and from the outside.

4. Printing Process

Next, an example of a procedure of the printing process by the image formation apparatus 1 is described below in detail with reference to a flowchart illustrated in FIG. 5. When the image formation apparatus 1 is turned on, the controller 4 reads out a printing process program from the storage 50 and executes the program, so as to start a printing procedure RT1 and then to proceed to step SP1. In step SP1, the controller 4 receives print data from the outside, and then proceeds to step SP2. In step SP2, the controller 4 executes a warm-up process, and then proceeds to step SP3.

In step SP3, the controller 4 determines whether or not to execute a deteriorated toner disposal (disposing the deteriorated toner) by the deteriorated toner disposal execution control unit 59. Specifically, when there is any one of the image formation units 8 in which the value of the deteriorated toner counts L is more than zero (that is, L>0), the deteriorated toner disposal execution control unit 59 determines to execute the deteriorated toner disposal. A positive result obtained by the determination in step S3 (Yes in step SP3) means that there is at least one of the image formation units 8 to which the deteriorated toner disposal procedure is to be done. If so, the controller 4 proceeds to step SP4. In step SP4, the controller 4 executes the deteriorated toner disposal procedure to the image formation unit 8 in which the deteriorated toner counts L is more than zero, and then proceeds to step SP5. To the contrary, a negative result obtained in the determination in step SP3 (No in step SP3) means that there is none of the image formation units 8 to which the deteriorated toner disposal procedure is to be done. If so, the controller 4 skips step SP4 so as not to execute the deteriorated toner disposal and proceeds to step SP5.

Figure 8:
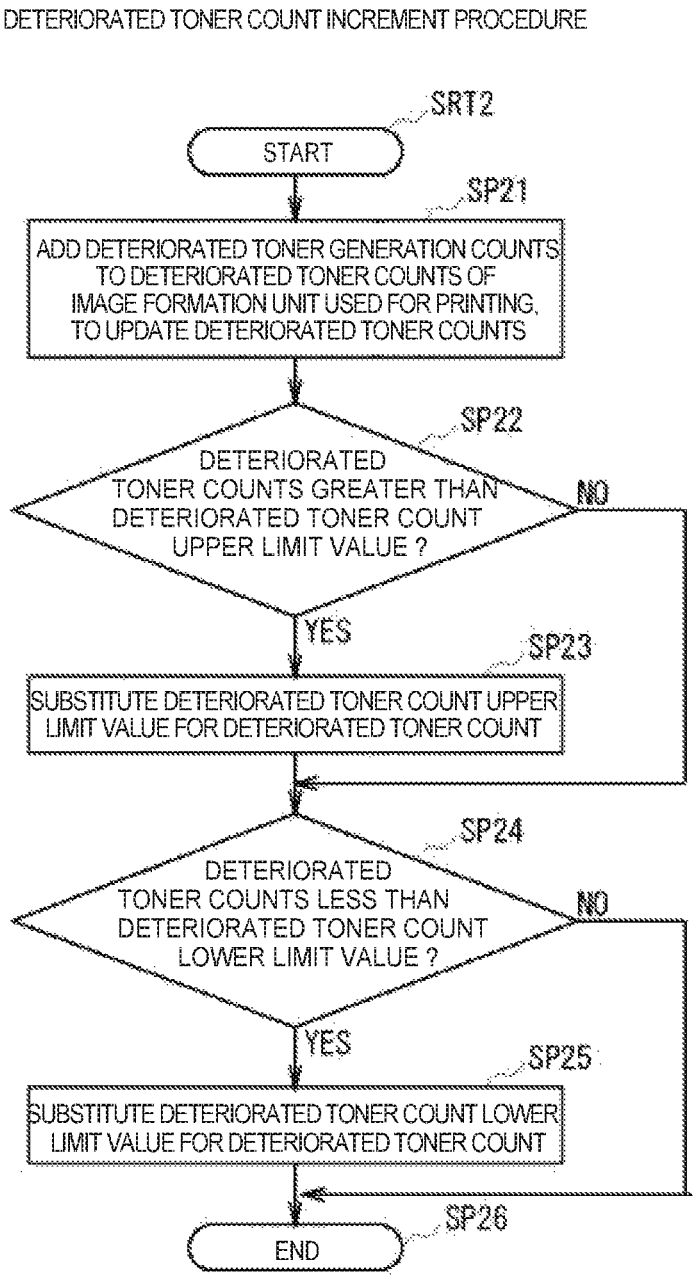
FIG. 8 is a diagram illustrating a flowchart of the deteriorated toner count increment procedure.

In step SP5, the controller 4 calculates, by the print data printing rate calculation unit 54, a printing rate Lduty of the received print data of one job and then proceeds to step SP6. In step SP6, the controller 4 calculates, by the deteriorated toner generation count calculation unit 55, the deteriorated toner generation counts Lcount by subtracting the printing rate Lduty from the toner waste slice value LS (that is, Lcount=LS−Lduty), and then proceeds to step SP7. In step SP7, the controller 4 executes an image formation unit selection procedure SRT1, such as being illustrated in FIG. 6, to select one of the image formation unit 8 in which the deteriorated toner is to be discarded, and then proceeds to step SP8. The deteriorated toner generation counts Lcount is a value according to the printing rate Lduty, and is to be used in a later described the deteriorated toner count increment procedure SRT2 (FIG. 8).

In step SP8, the controller 4 executes the printing process of the one job, and then proceeds to step SP9. In step SP9, the controller 4 executes a deteriorated toner count increment procedure SRT2, such as being illustrated in FIG. 8, to update the value of the deteriorated toner counts L of each of the image formation units 8, and then proceeds to step SP10.

In step SP10, the controller 4 determines whether there is a next job or not. A positive result obtained in such a determination in step SP10 (Yes in step SP10) means that there are still one or more print jobs to be executed. If so, the controller 4 returns to step SP5, to repeats the above described steps. To the contrary, a negative result obtained such a determination in step SP10 (No in step SP10) means that there are no more print jobs to be executed. If so, the controller 4 proceeds to step SP11, and then ends the printing procedure RT1.

5. Image Formation Unit Selection Procedure

Next, an example of a procedure of an image formation unit selection process by the controller 4 is described with reference to a flowchart illustrated in FIG. 6. In step SP7, the controller 4 starts an image formation unit selection procedure SRT1, such as being illustrated in FIG. 6, of the printing procedure RT1 (FIG. 5), and then proceeds to step SP11.

In step SP11, the controller 4 compares the deteriorated toner counts LA of the image formation unit 8A and the deteriorated toner counts LE of the image formation unit 8E to each other, and determines whether the value of the deteriorated toner counts LA is equal to or more than the value of the deteriorated toner counts LE (that is, LA LE) by the deteriorated toner count comparator 56.

A positive result obtained in such a determination in step SP11 (Yes in step SP11) means that the amount of the deteriorated toner accumulated in the image formation unit 8A is greater than that of the image formation unit 8E. If so, the controller 4 proceeds to step SP12. In step SP12, the controller 4 determines, by the printing rate high duty judgment unit 57, whether the printing rate Lduty is greater than the toner waste slice value LS (that is, Lduty>LS). A positive result obtained in such a determination in step SP12 (Yes in step SP12) means that the amount of the deteriorated toner in the image formation unit 8A is greater than that of the image formation unit 8E and the printing rate Lduty of the print job to be currently executed is a high duty, that is, a high printing rate. In this case, the controller 4 proceeds to step SP14. In step SP14, the controller 4 selects, by the image formation unit selector 58, the image formation unit 8A as the image formation unit 8 that is to use the toner for printing before the toner is deteriorated, and then proceeds to step SP16.

To the contrary, a negative result obtained in the determination in step SP12 (No in step SP12) means that the amount of the deteriorated toner in the image formation unit 8A is greater than that of the image formation unit 8E and the printing rate Lduty of the print job to be currently executed is a low duty, that is, a low printing rate. If so, the controller 4 proceeds to step SP15. In step SP15, the controller 4 selects, by the image formation unit selector 58, the image formation unit 8E as the image formation unit 8 that is to use the toner for printing before the toner is deteriorated, and then proceeds to step SP16.

To the contrary, a negative result obtained in the determination in step SP11 (No in step SP11) means that the amount of the deteriorated toner in the image formation unit 8E is greater than that of the image formation unit 8A. In this case, the controller 4 proceeds to step SP13. In step SP13, the controller 4 determines, by the printing rate high duty judgment unit 57, whether the printing rate Lduty is greater than the toner waste slice value LS (that is, Lduty>LS). A positive result obtained in such a determination in step SP13 (Yes in step SP13) means that the amount of the deteriorated toner in the image formation unit 8E is greater than that of the image formation unit 8A and the printing rate Lduty of the print job to be currently executed is a high duty, that is, a high printing rate. In this case, the controller 4 proceeds to step SP15. In step SP15, the controller 4 selects, by the image formation unit selector 58, the image formation unit 8E as the image formation unit 8 that is to use the toner for printing before the toner is deteriorated, and then proceeds to step SP16.

To the contrary, a negative result in the determination in step SP13 (No in step S13) means that the amount of the deteriorated toner in the image formation unit 8E is greater than that of the image formation unit 8A and the printing rate Lduty of the print job to be currently executed is a low duty, that is, a low printing rate. In this case, the controller 4 proceeds to step SP14. In step SP14, the controller 4 selects, by the image formation unit selector 58, the image formation unit 8A as the image formation unit 8 that is to use the toner for printing before the toner is deteriorated, and then proceeds to step SP16.

In step SP16, the controller 4 moves the one of the image formation units 8A and 8E that is not selected in the previous step SP14 or SP15 upwardly to the non-transfer position, and then proceeds to step SP17. In step SP17, the controller 4 moves the one of the image formation units 8A and 8E that is selected in the previous step SP14 or SP15 downwardly to the transfer position, and then proceeds to step SP18. In step SP18, the controller 4 ends the image formation unit selection procedure SRT1, and then proceeds to step SP8 in the printing procedure RT1 (FIG. 5).

As described above, the controller 4 compares the deteriorated toner counts LA of the image formation unit 8A and the deteriorated toner counts LE of the image formation unit 8E to each other, and selects, based on the printing rate Lduty of the print date with reference to the deteriorated toner generation counts Lcount and the toner waste slice value LS, which one of the image formation units 8A and 8E to be used for the printing. That is, the controller 4 selects, based on the amounts of the deteriorated toners of the development devices 40 of the image formation units 8 and the printing rate Lduty of the print data to be printed, one of the image formation units 8 to be used for printing.

The above described selection procedure for selecting the image formation unit 8A or 8B can be summarized in an image formation unit selection condition table TB1 illustrated in FIG. 7. That is, when the printing rate Lduty of the job to be printed is greater than the toner disposal slice value LS (Lduty>LS), the job to be printed is a high duty. When such a high duty print job is printed by an image formation unit 8, the toner in the image formation unit 8 can be used for the development before the toner would be deteriorated, and thus the amount of the deteriorated toner in the image formation unit 8 tends to be decreased. In view of this, when it is determined that the printing rate Lduty of the job to be printed is greater than the toner disposal slice value LS (Lduty>LS), the image formation apparatus 1 uses one of the image formation units 8A and 8E whose value of deteriorated toner counts L is larger than the other (that is, one of the image formation units 8A and 8E that has accumulated more of the deteriorated toner than the other) for printing, so as to reduce the amount of the deteriorated toner in the one of the image formation units 8A and 8B that has accumulated more of the deteriorated toner.

To the contrary, when the printing rate Lduty is not less than the toner disposal slice value LS (Lduty<LS), the job to be printed is a low duty. Thus, when such a low duty print job is printed by an image formation unit 8, the toner in the image formation unit 8 cannot be used for development before the toner would be deteriorated, and thus the amount of the deteriorated toner in the image formation unit 8 tends to be increased. In view of this, when it is determined that the printing rate Lduty is not less than the toner disposal slice value LS (Lduty<LS), the image formation apparatus 1 uses one of the image formation units 8A and 8E whose value of deteriorated toner counts L is less than the other (that is, one of the image formation units 8A and 8E that has accumulated less of the deteriorated toner than the other) for printing, even through the amount of the deteriorated toner in the used image formation unit 8A or 8E tends to be increased. With this operation, the image formation apparatus 1 can reduce a difference between the amounts of the deteriorated toners in the image formation unit 8A and the image formation unit 8E, in order to equalize the amounts of the deteriorated toners.

6. Deteriorated Toner Count Increment Process

Next, an example of a procedure of a deteriorated toner count increment process by the controller 4 is described with reference to a flowchart illustrated in FIG. 8. The controller 4 starts, at step SP9 of the printing procedure RT1 (FIG. 5), a deteriorated toner count increment procedure illustrated in FIG. 8, and then proceeds to step SP21.

In step SP21, the controller 4 increments (adds), to the deteriorated toner counts L of the image formation unit 8 that is used for printing, the deteriorated toner generation counts Lcount, so as to update the deteriorated toner counts L (that is, L=L+Lcount), and then proceeds to step SP22.

In step SP22, the controller 4 compares the (updated) deteriorated toner counts L of the image formation unit 8 that is used for printing with the deteriorated toner count upper limit value Lmax, and determines whether or not the value of the (updated) deteriorated toner counts L is greater than the deteriorated toner count upper limit value Lmax (that is, L>Lmax). When a positive result is obtained in step SP22 (Yes in step SP22), which indicates that the value of the deteriorated toner counts L exceeds the deteriorated toner count upper limit value Lmax, and thus the controller 4 proceeds to step SP23. In step SP23, the controller 4 substitutes the deteriorated toner count upper limit value Lmax for the value of the deteriorated toner counts L, and then proceeds to step SP24. To the contrary, when a negative result is obtained in step SP22 (No in step SP22), which indicates that the value of the deteriorated toner count L does not reach the deteriorated toner count upper limit value Lmax, the controller 4 skips step SP23 and proceeds to step SP24.

In step SP24, the controller 4 compares the (updated) deteriorated toner counts L of the image formation unit 8 that is used for printing, with the deteriorated toner count lower limit value Lmin, and determines whether or not the value of the (updated) deteriorated toner counts L is less than the deteriorated toner count lower limit value Lmin (that is, L<Lmin). When a positive result is obtained in step SP24 (Yes in step SP24), which indicates that the value of the deteriorated toner counts L falls below the deteriorated toner count lower limit value Lmin, the controller 4 proceeds to SP25. In step SP25, the controller 4 substitutes the deteriorated toner count lower limit value Lmin for the value of the deteriorated toner counts L, and the proceeds to step SP26. In step SP26, the controller 4 ends the deteriorated toner count increment procedure SRT2, and then proceeds to step SP10 in the printing procedure RT1 (FIG. 5). To the contrary, a negative result is obtained in step SP24 (No in step SP24), which indicates that the value of the deteriorated toner counts L is above (does not fall below) the deteriorated toner count lower limit value Lmin, the controller 4 skips step SP25 and proceeds to step SP26. In step SP26, the controller 4 ends the deteriorated toner count increment procedure SRT2, and then proceeds to step SP10 in the printing procedure RT1 (FIG. 5).

That is, the controller 4 updates, when the deteriorated toner counts L is greater than the deteriorated toner count upper limit value Lmax, the deteriorated toner counts L to the value of the deteriorated toner count upper limit value Lmax, and updates, when the deteriorated toner counts L is less than the deteriorated toner count lower limit value Lmin, the deteriorated toner counts L to the value of the deteriorated toner count lower limit value Lmin, so as to keep the deteriorated toner counts L within a specified range.

7. Comparison with Comparison Example

FIG. 9 is a diagram of an image formation apparatus status table TB2 illustrating an example of a state of the image formation apparatus 1 at a certain time. In the image formation apparatus status table TB2, the deteriorated toner counts LA and LE of the image formation units 8A and 8E are 0.0 and 0.0 respectively as the initial states thereof, and the toner disposal slice values LS of the image formation units 8A and 8E are 1.8 and 1.8 respectively. For a reference, the values of the drum counts, the drum life duration value, the waste toner counts, the waste toner life duration value, the belt counts, and the belt life duration value are also listed in the image formation apparatus status table TB2 of FIG. 9. From this state, for example, seventeen jobs of print data are printed.

FIG. 10 illustrates a print result table TB3 showing a printing result executed by an image formation apparatus according to a comparison example, when the seventeen jobs of print data are printed. The printing rate Lduty of each of the jobs is listed in the leftmost column in the table TB3. After such print jobs are all printed in the comparison example, as listed in the bottom row in table TB3, the deteriorated toner counts LA of the image formation unit 8A gets the value of 0.2, which is greater than zero (L>0), and thus the deteriorated toner disposal process is executed in the image formation unit 8A, although the deteriorated toner counts LE of the image formation unit 8E gets the value of −116.8, which is still not greater than zero, and thus the deteriorated toner disposal process is not executed in the image formation unit 8E.

To the contrary, FIG. 11 illustrates a print result table TB4 showing a printing result executed by the image formation apparatus according to above described one or more embodiments, when the same seventeen jobs of print data are printed. The printing rate Lduty of each of the jobs in the print result table TB4 (in FIG. 11) is the same as in the print result table TB3 (FIG. 10). When printing the job having the printing rate Lduty of the value of 2 as listed in the second row in table TB4 from the state where both of the deteriorated toner counts LA and LE are zero as listed in the first row in table TB4, the image formation apparatus 1 selects the image formation unit 8A to execute printing because the printing rate Lduty (2.0) of the print data is greater than the toner disposal slice value LS (1.8) (Lduty>LS) and the deteriorated toner counts LA (0) of the image formation unit 8A is equal to or more than the deteriorated toner counts LE (0) of the image formation unit 8E (LA LE). With this, based on the formula of LA=LA+Lcount and the formula of Lcount=LS−Lduty, the deteriorated toner counts LA is calculated by the formula of LA=LA+(LS−Lduty), to be updated to the value of (0+(1.8−2), that is, the value of −0.2, as listed in the second row in table TB4. The image formation apparatus 1 executes the same calculation procedure in the following rows.

Thus, as listed in the bottom row in table TB4, the deteriorated toner counts LA of the image formation unit 8A finally gets the value of −97.5 and the deteriorated toner counts LE of the image formation unit 8E gets the value of −19.1, both of which are less than zero. Thus, either of the image formation unit 8A or 8E does not execute the deteriorated toner disposal procedure.

8. Effects

According to the above described configuration, the image formation apparatus 1 includes the waste toner collection container 48 integrally formed with the development device 40, and executes operations comprising: at the start of the printing of each job, calculating the printing rate Lduty of the print data to be printed; and selecting, based on the calculated printing rate Lduty of the print data to be printed and the deteriorated toner counts L of both of the image formation units 8A and 8E which use the toners of the same color (black), one of the image formation units 8A and 8E to be used for transferring (developing) the black toner.

Specifically, when the printing rate Lduty of the print data to be printed is a high printing rate, greater than the toner disposal slice value LS serving as the predetermined threshold, the image formation apparatus 1 selects one of the image formation units 8A and 8E whose value of the deteriorated toner counts L is higher than the other. To the contrary, when the printing rate Lduty of the print data to be printed is a low printing rate, not greater than the toner disposal slice value LS, the image formation apparatus 1 selects one of the image formation units 8A and 8E whose value of the deteriorated toner counts L is lower than the other.

With this operation, when printing the print data having a high printing rate Lduty, the image formation apparatus 1 performs printing by one of the image formation units 8 that contains the deteriorated toner more than the other(s), so as to use the toner for the development before the toner is deteriorated. To the contrary, when printing the print data having a low printing rate Lduty, which tends to generate the deteriorated toner, the image formation apparatus 1 performs printing by one of the image formation units 8 that contains the deteriorated toner less than the other(s). Accordingly, the image formation apparatus 1 can efficiently accumulate the deteriorated toner by decreasing a difference between the same color image formation units 8 in the amounts of the deteriorated toners therein.

Therefore, each of the image formation units 8 in the image formation apparatus 1 can avoid the execution of the toner disposal as much as possible, to reduce the amount of the deteriorated toner collected in the waste toner collection container 48, so as to delay the time when the waste toner collection container 48 gets full. Accordingly, the image formation apparatus 1 can avoid the waste toner collection container 48 being full even when the photosensitive drum 45 or the like in the image formation unit has not yet reached the end of the life, so as to avoid the replacement of the development device 40 as much as possible. That is, the image formation apparatus 1 can extends the replacement cycles of the image formation units 8, and thus may be able to use up the image formation units 8 until the ends of the lives.

According to the above described configuration, the image formation apparatus 1 includes: the image formation units 8 serving as image formation parts each of which includes the development device 40 serving as a developer image development part that forms (develops) the toner image serving as a developer image; the toner cartridge 41 serving as a developer container that accommodates therein toner serving as a developer to be supplied to the development device 40; and the waste toner collection container 48 serving as a deteriorated developer container that accommodates therein a deteriorated toner serving as a deteriorated developer discharged from the development device 40. The image formation apparatus 1 further includes: the deteriorated toner count comparator 56 that collects the deteriorated toner counts L serving as a value based on a history of printing rates of the image formation units 8; the print data printing rate calculation unit 54 that calculates a printing rate of a received print data; and the image formation unit selector 58 that selects, based on the deteriorated toner counts L of the image formation units 8 collected by the deteriorated toner count comparator 56 and the printing rate of the received print data calculated by the print data printing rate calculation unit 54, one of the image formation units 8, to be used for perform an image formation of the received print data.

With this configuration, for the print data of high printing rate Lduty, the image formation apparatus 1 performs printing by one of the same color image formation units 8 that contains the deteriorated toner more than the other(s), so as to use the toner for the development before the toner is deteriorated. To the contrary, for the print data of low printing rate Lduty, which tends to generate the deteriorated toner more, the image formation apparatus 1 performs printing by one of the same color image formation units 8 that contains the deteriorated toner less than the other(s). Accordingly, the image formation apparatus 1 can efficiently accumulate the deteriorated toner by decreasing a difference between the same color image formation units 8 in the amounts of the deteriorated toners therein.

9. Other Embodiments or Modifications

In one or more embodiments described above, in step SP11 in the image formation unit selection procedure SRT1 (FIG. 6), the deteriorated toner counts L of the image formation units 8 are compared to each other. However, the invention is not limited to this. For example, in a modification, the image formation units may be compared to each other in a temperature around or of a component thereof, an operating rate thereof, or the like, which indicates a density of operation at which the printing is performed in a specific time duration. That is, in a modification, the image formation units may be compared to each other in a value based on the history of printing rates of each of the image formation units.

Figure 5:
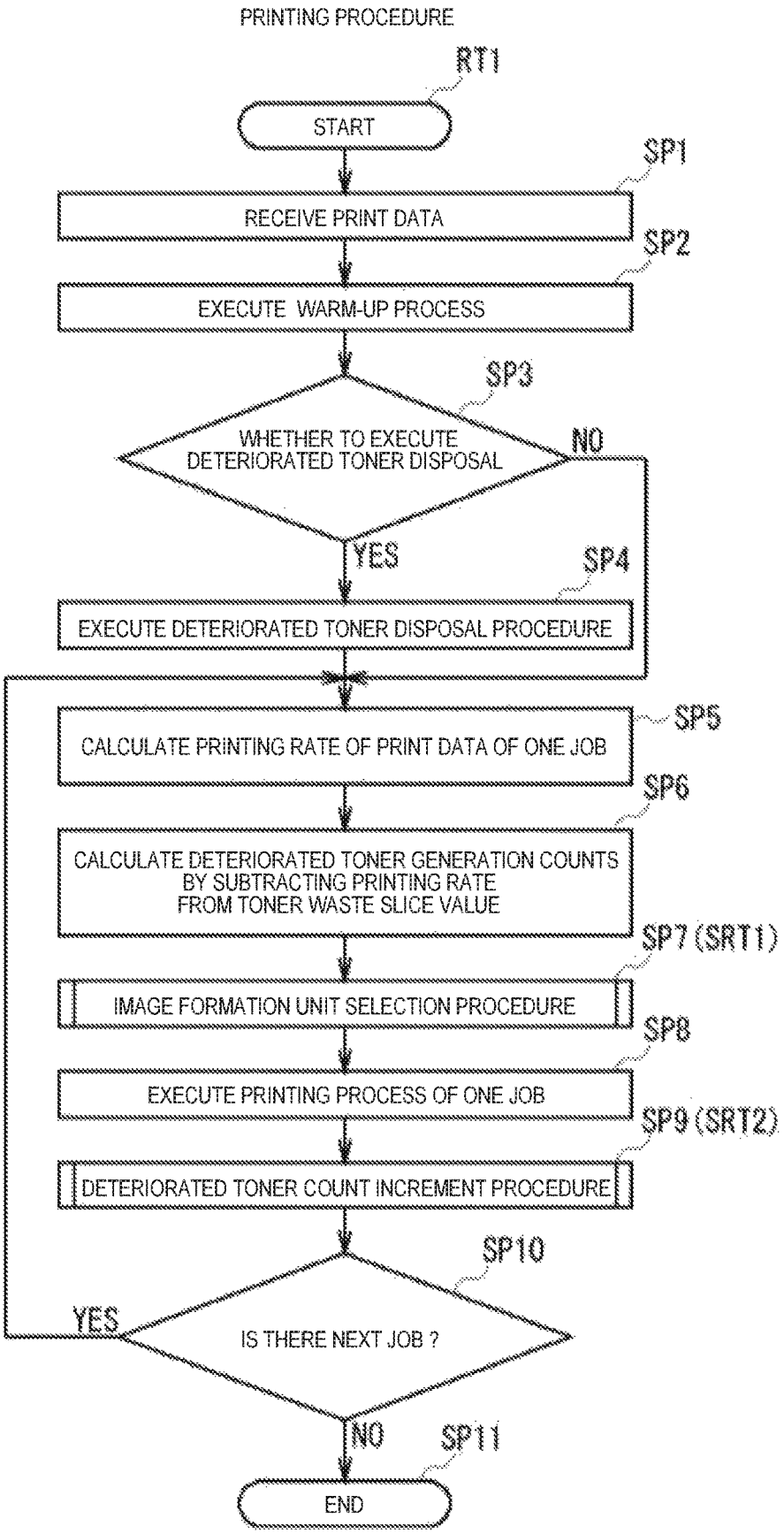
FIG. 5 is a diagram illustrating a flowchart of a printing procedure.
Figure 6:
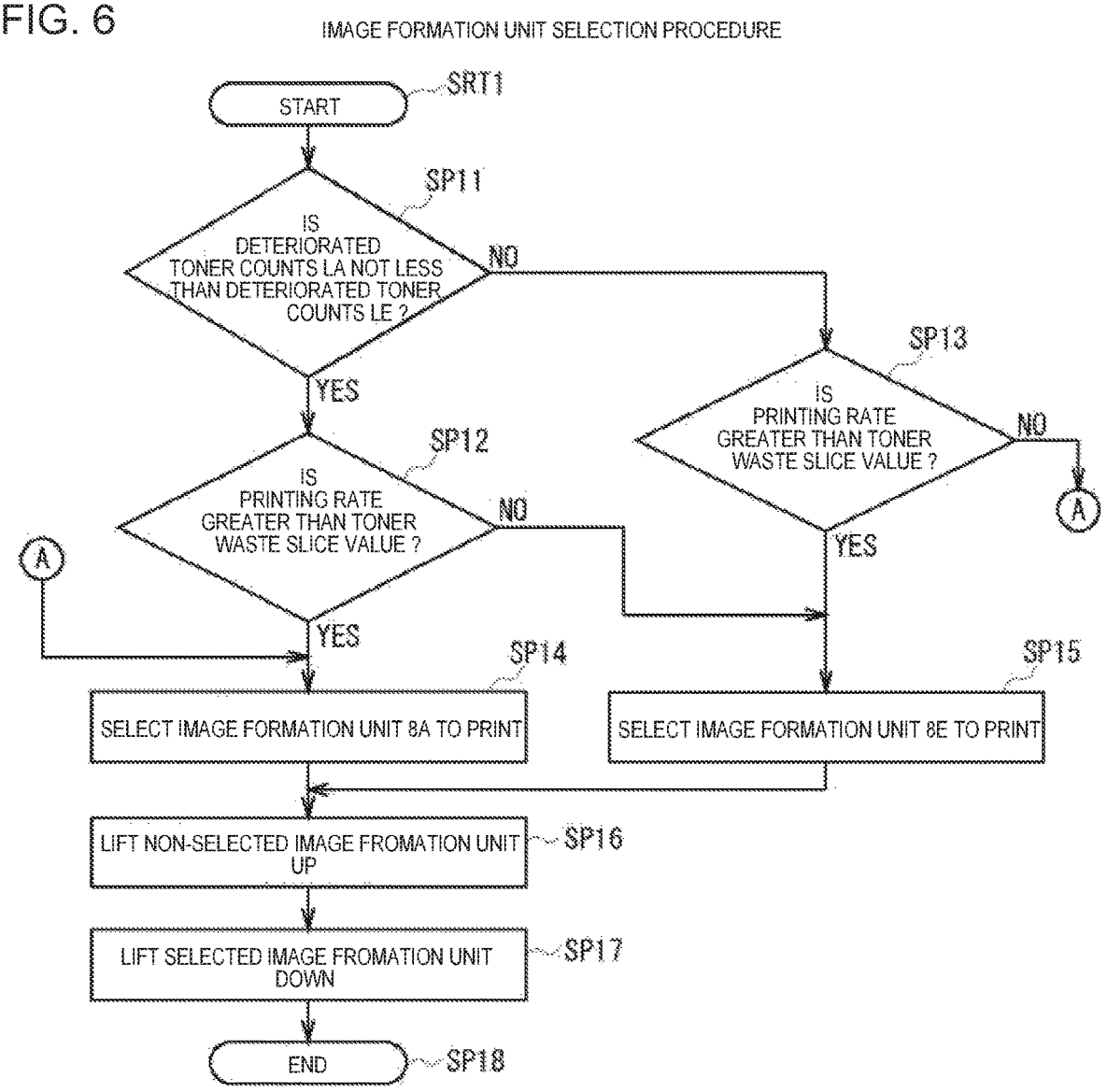
FIG. 6 is a diagram illustrating a flowchart of an image formation unit selection procedure.

In one or more embodiments described above, in step SP21 in the deteriorated toner count increment procedure SRT2 (FIG. 8), the value of the deteriorated toner counts L is updated by adding, to the deteriorated toner counts L, the deteriorated toner generation counts Lcount calculated in step SP6 which is a step before printing in the printing procedure RT1 (FIG. 5). However, the invention is not limited to this. For example, in a modification, in step SP21 in the deteriorated toner count increment procedure SRT2 (FIG. 8), the value of the deteriorated toner counts L may be updated by adding, to the deteriorated toner counts L, the deteriorated toner generation counts Lcount actually measured when performing the printing In one or more embodiments described above, the printing rate Lduty is calculated for each job. However, the invention is not limited to this. For example, in a modification, the printing rate Lduty may be calculated for each page.

In one or more embodiments described above, in steps SP12 and SP13 in the image formation unit selection procedure SRT1 (FIG. 6), the printing rate Lduty is compared with the toner disposal slice value LS. However, the invention is not limited to this. For example, in a modification, the deteriorated toner generation counts Lcount may be compared with a predetermined threshold.

In one or more embodiments described above, the storage 50 is provided at the body of the image formation apparatus 1. However, the invention is not limited to this. For example, in a modification, a storage (or a memory) may be proved at each of the image formation units 8 and values related to each of the image formation units 8 may stored in the storage of the corresponding image formation unit 8. In such a case, the controller 4 may obtain the values or information of each of the image formation units 8 from the storage of the image formation unit 8 through a wired communication or a wireless communication, for example, with a wireless tag such as a RFID (Radio Frequency Identifier) or the like provided at the image formation unit 8.

In one or more embodiments described above, the invention is applied to the image formation apparatus 1 including two image formation units 8A and 8E, serving as the image formation units for the same color of black. However, the invention is not limited to this. For example, in a modification, the invention may be applied to an image formation apparatus including two image formation units 8 of a same color other than black, may be applied to an image formation apparatus including three or more image formation units 8 of a same color of any color, or may be applied to an image formation apparatus including a pair of image formation units of a same color of a first color (for example, black) and a pair of image formation units of a same color of a second color (for example, white) different from the first color. That is, the invention may be applied to an image formation apparatus including any number of image formation units of a same color and a combination thereof.

In one or more embodiments described above, the invention is applied to the image formation apparatus 1 in which the print head 42 such as the LED head writes the latent image on the photosensitive drum 45. However, the invention is not limited to this. For example, in a modification, the invention may be applied to an image formation apparatus having a print head of another type, such as a leaser head or etc., writing a latent image.

In one or more embodiments described above, the invention is applied to the image formation apparatus 1 including the five image formation units 8 for four colors. However, the invention is not limited to this. For example, in a modification, the invention may be applied to an image formation apparatus having four or less image formation units for three or less colors, an image formation apparatus having six or more image formation units for five or more colors, or an image formation apparatus having any numbers of image formation units of any type.

In one or more embodiments described above, the image formation apparatus 1 serving as an image formation apparatus is configured to include the deteriorated toner count comparator 56 serving as a collection part, the print data printing rate calculation unit 54 serving as a printing rate calculator, and the image formation unit selector 58 serving as an image formation part selector. However, the invention is not limited to this. For example, in a modification, an image formation apparatus may be configured to include a storage, a printing rate calculator, and an image formation part selector, each of which has any type.

One or more embodiments and modifications can also be applied to a computer that instructs an image formation apparatus such as a printer to print an image, or an electrical device of any type that executes a process related to an image, including an image scanner, a facsimile machine, a copy machine, or the like The invention includes other embodiments and modifications in addition to the above-described one or more embodiments and modifications without departing from the spirit of the invention. The one or more embodiments and modifications are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

a plurality of image formation parts each of which includes: a developer image development part configured to form a developer image; a developer container that accommodates a developer to be supplied to the developer image development part;

and a deteriorated developer container that accommodates a deteriorated developer discharged from the developer image development part;

a collection part that collects a value based on a history of printing rates of each of the plurality of image formation parts;

a printing rate calculator that calculates a printing rate of a received print data; and an image formation part selector that selects, based on the value based on the history of printing rates of each of the plurality of image formation parts collected by the collection part and the printing rate of the received printed data calculated by the printing rate calculator, one of the plurality of image formation parts, to be used for performing printing of the received print data.

2. The image formation apparatus according to claim 1, wherein the value based on the history of printing rates of each of the plurality of image formation parts comprises deteriorated toner counts of each of the plurality of image formation parts, and the image formation part selector selects one of the plurality of image formation parts to be used for performing printing of the received print data, based on the deteriorated toner counts of each of the plurality of image formation parts and the printing rate of the received print data.

3. The image formation apparatus according to claim 2, wherein the image formation part selector selects one of the plurality of image formation parts whose deteriorated toner counts are higher than the other(s), when the printing rate of the received print data is a high printing rate, greater than a predetermined threshold, and selects one of the plurality of image formation parts whose deteriorated toner counts are lower than the other(s), when the printing rate of the received print data is a low printing rate, not greater than the predetermined threshold.

4. The image formation apparatus according to claim 1, wherein colors of the developers used by the plurality of image formation parts is a same.

5. The image formation apparatus according to claim 1, wherein the deteriorated developer container is formed integrally with the image formation part.

6. A method of selecting, among a plurality of image formation parts each of which includes a developer image development part configured to form a developer image, one of the plurality of image formation parts, to be used for printing, the method comprising:

storing a value based on a history of printing rates of each of the plurality of image formation parts;

calculating a printing rate of a received print data; and selecting, based on the value based on the history of printing rates of each of the image formation parts and the printing rate of the received printed data, one of the plurality of image formation parts, to be used for performing printing of the received print data.

* * * * *